US010323474B2

(12) United States Patent
Olsen et al.

(10) Patent No.: US 10,323,474 B2
(45) Date of Patent: Jun. 18, 2019

(54) HEAVE COMPENSATED MANAGED PRESSURE DRILLING

(71) Applicant: Halliburton Energy Services, Inc., Houston, TX (US)

(72) Inventors: Karl Kristian Olsen, Algard (NO); Tim Rohne Tonnessen, Raege (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/574,391

(22) PCT Filed: Jul. 7, 2015

(86) PCT No.: PCT/US2015/039313
§ 371 (c)(1),
(2) Date: Nov. 15, 2017

(87) PCT Pub. No.: WO2017/007452
PCT Pub. Date: Jan. 12, 2017

(65) Prior Publication Data
US 2018/0135366 A1 May 17, 2018

(51) Int. Cl.
*E21B 7/12* (2006.01)
*E21B 21/00* (2006.01)
(Continued)

(52) U.S. Cl.
CPC ..... *E21B 21/08* (2013.01); *E21B 7/12* (2013.01); *E21B 21/001* (2013.01);
(Continued)

(58) Field of Classification Search
CPC ..... E21B 19/002; E21B 19/16; E21B 21/001; E21B 21/08; E21B 21/103; E21B 47/06; E21B 7/12
See application file for complete search history.

(56) References Cited

U.S. PATENT DOCUMENTS

2012/0241163 A1* 9/2012 Reitsma ..... E21B 19/09 166/355
2012/0255776 A1* 10/2012 Knudsen ..... E21B 21/08 175/25

(Continued)

FOREIGN PATENT DOCUMENTS

EP 2295712 A2 3/2011

OTHER PUBLICATIONS

Preliminary Report on Patentability issued in related PCT Application No. PCT/US2015/039313, dated Jan. 8, 2018, 13 pages.

(Continued)

*Primary Examiner* — James G Sayre
(74) *Attorney, Agent, or Firm* — John W. Wustenberg; Baker Botts L.L.P.

(57) ABSTRACT

In accordance with embodiments of the present disclosure, system and methods for controlling borehole pressure in a MPD system to compensate for heave effects on a drilling rig are provided. The systems and method described herein involve calculating and implementing set points for two or more MPD system components in real time. These MPD components that are controlled via the dynamic set points may include a choke, a backpressure pump (BPP), a rig pump diverter (RPD), a continuous circulation device, one or more mud pumps, a pressure relief system, or some combination thereof. By calculating and providing these set points in real-time during various well and drilling operations, non-productive time, well control events, and costs to remedy issues resulting from improper pressure levels within the borehole may be mitigated or avoided.

19 Claims, 6 Drawing Sheets

(51) Int. Cl.

| | |
|---|---|
| ***E21B 21/08*** | (2006.01) |
| ***E21B 33/08*** | (2006.01) |
| ***E21B 34/04*** | (2006.01) |
| ***E21B 44/00*** | (2006.01) |
| ***E21B 33/064*** | (2006.01) |

(52) U.S. Cl.
CPC ..... *E21B 33/064* (2013.01); *E21B 34/04* (2013.01); *E21B 44/00* (2013.01); *E21B 33/085* (2013.01)

(56) References Cited

U.S. PATENT DOCUMENTS

2012/0277918 A1* 11/2012 Pool ..... E21B 21/08 700/282
2014/0090888 A1 4/2014 Smith et al.

OTHER PUBLICATIONS

International Search Report and Written Opinion issued in related PCT Application No. PCT/US2015/039313 dated Apr. 14, 2016, 16 pages.

* cited by examiner

HEAVE COMPENSATED MANAGED PRESSURE DRILLING

CROSS-REFERENCE TO RELATED APPLICATION

The present application is a U.S. National Stage Application of International Application No. PCT/US2015/039313 filed Jul. 7, 2015, which is incorporated herein by reference in its entirety for all purposes.

TECHNICAL FIELD

The present disclosure relates generally to well drilling and, more particularly, to controlling borehole pressure of a well during various well drilling operations.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a borehole at a desired well site, treating the borehole to optimize production of hydrocarbons, and performing the necessary steps to produce and process the hydrocarbons from the subterranean formation.

In conventional drilling operations, a drill bit is mounted in a bottom hole assembly (BHA) at the end of a drill string (e.g., drill pipe plus drill collars). At the surface a rotary drive turns the string, including the bit at the bottom of the hole, while drilling fluid (or "mud") is pumped through the string and returned through an annulus. Various well systems may control borehole pressure of a well during this drilling process. In a conventional open well system, piping/riser for returning drilling fluid is typically open to atmospheric pressure. Closed-loop well systems include surface equipment to which the returning drilling fluid can be diverted.

Certain managed pressure drilling (MPD) systems may be characterized as closed and pressurized drilling fluid systems. MPD and like systems provide various techniques for regulating borehole pressure. However, existing pressure regulation techniques are often inadequate for use on certain types of drilling rigs to drill wells through reservoir formations.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
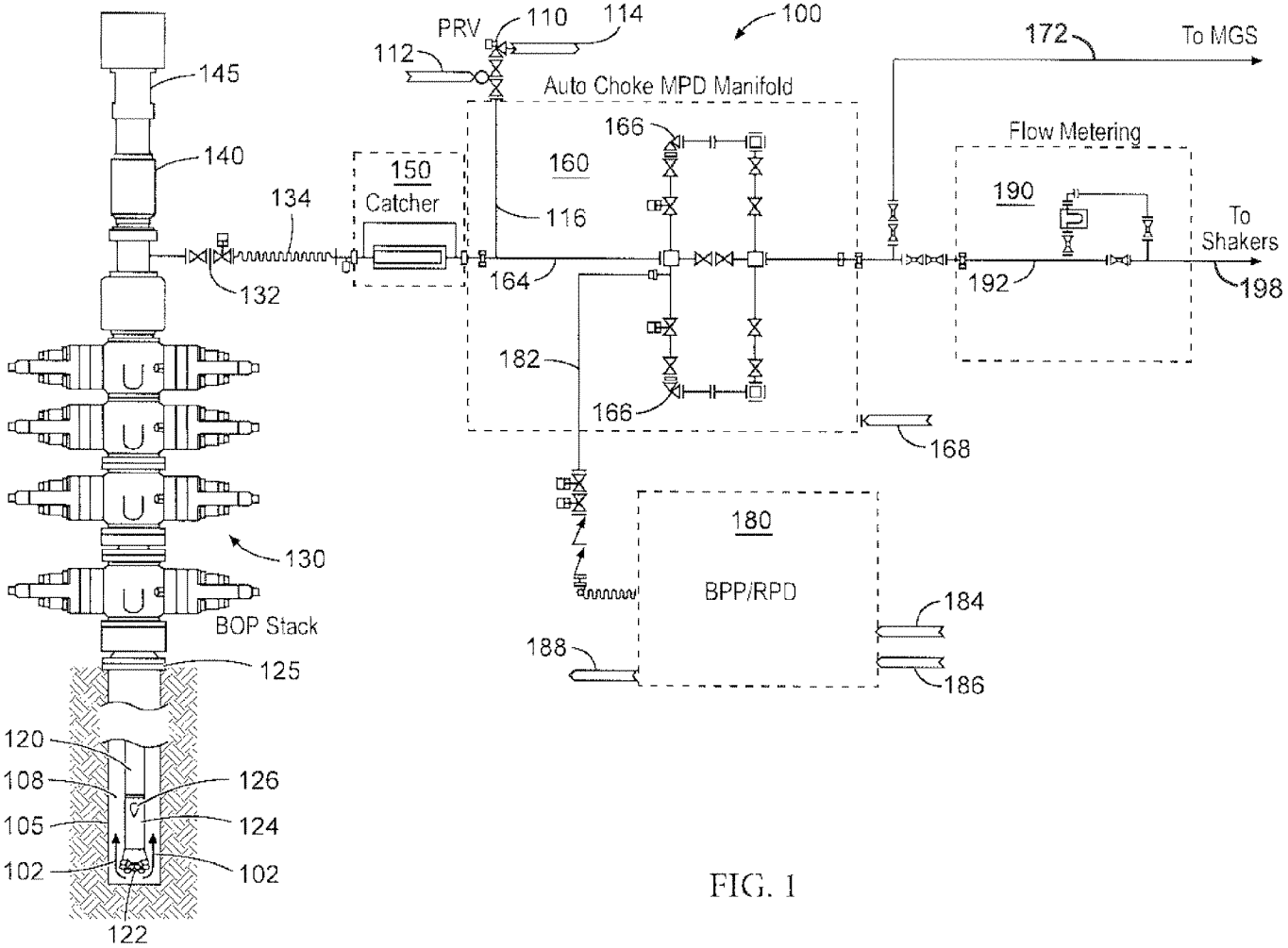
FIG. 1 is an example of a well system that may perform managed pressure drilling (MPD) operations, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to systems and methods for dynamically controlling set points of managed pressure drilling (MPD) equipment used during various well and drilling operations. These dynamic set points may be provided to one or more controllers associated with MPD equipment at certain time intervals during various well and drilling operations, such that a series of consecutive set point values account for changes to the pressure in the borehole (or wellbore) during such operations.

According to embodiments described herein, a dynamic set point system is utilized to enable precise borehole pressure management of wells that are being drilled in offshore environments, for example. MPD systems are currently not used on floating vessels/platforms for drilling wells in offshore environments with harsh weather conditions. In such harsh environments, floating vessels are subject to weather-related heave due to wind and waves. In a closed-loop MPD system, this heave can lead to large pressure differentials within the borehole due to surge and swab effects as drill pipe moves up and down relative to the riser and the borehole. For these reasons, it is now recognized that new MPD systems and control methods are needed to mitigate the surge/swab effects on borehole pressure in wells that are drilled from floating platforms/vessels subjected to large amounts of heave.

To that end, present embodiments allow for controlling borehole pressure in a MPD system to compensate for heave effects on a drilling rig, among other things. The systems and method described herein involve calculating and implementing set points for two or more MPD system components in real time. These MPD components that are controlled via the dynamic set points may include a choke, a backpressure pump (BPP), a rig pump diverter (RPD), a continuous circulation device, one or more mud pumps, a pressure relief valve (PRV) or some combination thereof. By calculating and providing these set points in real-time during various well and drilling operations, non-productive time and costs to remedy issues resulting from improper pressure levels within the borehole (e.g., a stuck pipe or damage to the reservoir formation or marine riser) may be mitigated or avoided. In addition, the pressure compensation facilitated through this process may prevent undesirable pressure oscillation on various MPD system components.

As shown in the examples provided herein, dynamically calculating and providing set points to multiple MPD components can enable precise control of borehole pressure such that pressure is maintained within a desired pore-pressure-fracture-gradient window even during changing pressure conditions associated with heave on a drilling unit/vessel. In this regard, choke set points, BPP/RPD set points, mud pump set points, and/or continuous circulation set points are calculated in real-time and provided to an associated controller, in accordance with aspects of the present disclosure.

The present embodiments may utilize primarily top-side equipment to provide compensation for heave experienced on a rig that uses MPD components. The disclosed systems and methods may utilize data provided by certain control systems that are already present in many MPD well systems and floating rigs/vessels, such as a rig drilling control system, a riser management/tensioner system, and a rig dynamic positioning system. This makes the disclosed methods relatively easy and cost effective to incorporate into existing rigs.

Turning now to the drawings, FIG. 1 illustrates a well system 100. A well as used herein with respect to the well system 100 can be, but is not limited to, an oil and gas well. In some implementations, the well system 100 may include a drilling rig, semi-submersible platform, fixed platform, or floating platform or vessel, for example. The well system 100 may include a pressure relief valve (PRV) assembly 110, a wellhead 125, a blowout preventer (BOP) stack 130, a choke manifold 160, and a flow meter assembly 190. The well system 100 may also include additional components illustrated in FIG. 1, as well as additional components not expressly identified. The disclosed well system 100 may enable managed pressure drilling for precisely controlling borehole pressure of a well formed through a subterranean formation.

In certain embodiments, the well system 100 may include a drill string 120 that is configured to pass through the wellhead 125 to drill a borehole 105. The drill string 120 may include a drill bit 122 configured to rotate and pass drilling fluid 102 (e.g., mud) therethrough. In this regard, drilling fluid 102 may be circulated through the drill string 120, out of the drill bit 122, and upward through an annulus 108 formed at least partially between an outer surface of drill string 120 and the wall of the borehole 105. Drilling fluid 102 may be circulated for the purpose of cooling the drill bit 122, lubricating the drill string 120, and removing cuttings from the borehole 105, for example. The drill string 120 may include one or more sensors 124 to provide bottom hole measurements and a one-way flow valve 126 (or similar non-return or check valve). The one or more sensors 124 may include, for example, a pressure while drilling (PWD) sensor, measurement while drilling (MWD) sensor, and/or logging while drilling (LWD) sensor. Additionally or alternatively, the drill string 120 may include various sensors integrated with the drill pipe (e.g., wired drill pipe) or tubing, to provide pressure readings and other measurements at other positions along the drill string 120 (e.g., not limited to the BHA or the surface).

The BOP stack 130 may be coupled to the wellhead 125, and may include one or more valves to prevent the escape of fluid pressure in the borehole 105 in response to a severe kick situation experienced downhole. One or more pressure sensors may be disposed in the wellhead 125 to sense pressure in the wellhead 125 below the BOP stack 130, for example. The well system 100 may further include a rotating control device (RCD) 140 disposed above the BOP stack 130. The RCD 140 can seal a top portion of the drill string 120 above the wellhead 125 via one or more rubber elements designed to rotate with the drill string 120. Other embodiments may include a designated control device seal, which is designed without bearings and therefore does not rotate with the drill string 120. However, such designated control device seals may utilize various lubricants to reduce frictional wear on the seal, allowing these seals to function similarly to the RCD 140. The RCD 140 (or designated control device seal) may enable control of the borehole pressure by sealing the annulus 108 such that the annulus 108 is isolated from the atmosphere.

Still referring to FIG. 1, the drill string 120 may extend upwardly through the RCD 140 and be operatively coupled to one or more components of a rotary table and standpipe assembly 145. While not shown, the rotary table and standpipe assembly 145 may include a rotary table, top drive or swivel, standpipe, standpipe line, Kelly, one or more pumps (i.e., drilling fluid or cement pumps, depending on the application), and/or other top-side drilling equipment.

In some embodiments, the rotary table and standpipe assembly 145 may include a continuous circulation device. The continuous circulation device may be operatively coupled to the rotary table and configured to provide continuous circulation of drilling fluid 102 by allowing one or more drilling fluid pumps (not shown) to stay active when a new drill pipe segment is being connected to the drill string 120. In this regard, the continuous circulation device can be configured to maintain constant downhole pressure during connections (e.g., connection mode). For example, the continuous circulation device may include a sealable internal chamber into which drilling fluid 102 may be pumped from one or more ports. The internal chamber may be configured to enclose a section of the drill string 120 between a junction of a topmost drill pipe and a top drive. As such, continuous drilling fluid circulation is possible by pressurizing the internal chamber with drilling fluid 102 via the one or more ports and then separating the top drive from the topmost drill pipe. Thus, drilling fluid 102 may flow into an open end of the topmost drill pipe via the pressurized chamber.

A bottom area of the pressurized chamber can be isolated (e.g., activating blind rams to bisect the internal chamber above the open end of the topmost drill pipe) so that drilling fluid 102 can be continuously injected into the open end of the topmost drill pipe while the top drive is removed from a top area of the internal chamber of the continuous circulation device (e.g., after drilling fluid flow from a standpipe manifold has been stopped). A new section of drill pipe can be connected to the top drive and guided into the continuous circulation device whereby an open end of the new section of drill pipe can be seamlessly introduced into the internal chamber when the top area is once again in fluid communication with the pressurized bottom area of the internal chamber (e.g., after release of the blind rams within the internal chamber). Drilling fluid 102 may then be injected into the open end of the topmost drill pipe with the internal chamber via the one or ports of the continuous circulation device and the standpipe via the open end of the new section of drill pipe connected to the top drive. The open end of the topmost drill pipe and the open end of the new section of drill pipe may be guided to establish contact. The new section of drill pipe can then be rotated to seamlessly connect the drill pipe segments together. After connection, delivery of drilling fluid 102 via the ports of the continuous circulation device can cease and the internal chamber may be depressurized. Delivery of drilling fluid 102 for circulation through the drill string 120 and into the borehole 105 can now be provided solely by the top drive and standpipe connected to the new drill pipe section (now the topmost drill pipe).

In other embodiments, continuous circulation systems having a simpler construction may be used. Such continuous circulation systems may be formed as subs fitted between drill pipe/tubing stands, these subs having a side entry port and a means for shutting off the flow above the sub. This may enable the same functionality as the larger continuous circulation device, while providing much of the same practical transition of flow by allowing connections to be conducted through the wellbore without shutting off circulation at any point.

In operation, returning drilling fluid 102 may exit the wellhead 125 via one or more valves 132 disposed at a top of the BOP stack 130 below the RCD 140, for example. The one or more valves 132 can be in fluid communication with the annulus 108 and a return flowline 134. The return flowline 134 may be coupled to a catcher 150 (e.g., junk catcher) to remove various objects from the returning drilling fluid 102. For example, the catcher 150 may be configured to catch and redirect objects from the returning drilling fluid 102 that have accidentally been injected into or left inside a drill pipe of the drill string 120 prior to being put down hole. One or more flow meters or sensors may be positioned along the return flowline 134 proximal to the catcher 150. The catcher 150 may be fluidly coupled to a choke manifold 160 via a return flowline 164. The choke manifold 160 includes one or more fully independent chokes 166 (e.g., in a redundant formation). One or more flow meters or sensors may be arranged throughout sections and flowlines of the choke manifold 160.

A pressure relief valve (PRV) assembly 110 may include one or more pressure relief valves or similar devices for controlling flow. For example, two pressure relief valves may be used in some implementations so that if a first pressure relief valve malfunctions (e.g., fails to reseat), a second pressure relief valve can be switched into operation. The PRV assembly 110 may also include one or more sensors or flow meters, a flush point 112, and a discharge port 114. In operation, the one or more pressure relive valves of the PRV assembly 110 can discharge drilling fluid 102 to provide pressure relief in excess of a maximum allowable pressure of the well system 100 during sudden changes in borehole pressure.

The choke manifold 160 may be fluidly coupled to the PRV assembly 110 via a return flowline 116, which is in fluid communication with the return flowline 164. Backpressure may be applied to the annulus 108 by variably restricting flow of the returning drilling fluid 102 via operation of the chokes 166. The choke manifold 160 may include an air pressure port 168 for operating the chokes 166. Further backpressure may be applied by a backpressure pump (BPP) 180, in accordance with certain embodiments.

The BPP 180 may be fluidly coupled to the choke manifold 160 via a flowline 182. However, in other embodiments the BPP 180 may be fluidly coupled to the BOP stack 130 in a position that provides crossflow over the flowspool to the left of the valves 132. Regardless of where the BPP 180 is positioned, the BPP 180 may include a charge pump port 184, a cooling water port 186, and a water discharge port 188, for example. Similarly, one or more flow meters or sensors may be arranged throughout various sections of the BPP 180, including the flowline 182. In this regard, the BPP 180 can provide pressure into the return flowlines so that the one or more chokes 166 can remain open during drill pipe connections (e.g., connection mode). Having the one or more chokes 166 open and operable at this time enables the choke manifold 160 to respond to changes in borehole pressure during drill pipe connections and other well operations.

In some embodiments, a rig pump diverter (RPD) may be used alternatively or in addition to the BPP 180. For example, the RPD may include a manifold with a choke for diverting the flow of drilling fluid 102 from the one or more drilling fluid pumps to provide continuous fluid flow to the choke manifold 160 during drill pipe connections, for example. In this regard, flow of the drilling fluid 102 may be diverted from the standpipe to the choke manifold 160, thereby applying backpressure to the annulus 108 during various non-drilling well operations to maintain borehole pressure, in accordance with some embodiments. Whether the BPP/RPD 180 is utilized in particular embodiments, the dynamic pressure applied by either to the choke manifold 160 can be advantageous over a static choke implementation when drilling operations ramp down or stop, for example.

The choke manifold 160 may be fluidly coupled to a flow meter assembly 190 via a return flowline 192. The flow meter assembly 190 may include one or more flow meters or sensors for measuring the returning drilling fluid 102, for example. One or more additional flow meter assemblies 190 may be used in combination with the illustrated flow meter assembly 190, depending on the operation. The one or more flow meter assemblies 190 may be fluidly coupled to a shaker return flowline 198, which conveys the drilling fluid to solids control units that remove debris from the drilling fluid. It should be noted that other flow meters may be hooked up to an outlet or suction side of the high pressure mud pumps on the rig, and/or to a suction inlet of the BPP/RPD 180.

The choke manifold 160 may also be fluidly coupled to a drilling fluid-gas separator return flowline 172. A drilling fluid-gas separator (e.g., a mud gas separator or MGS) may be configured to capture and separate a volume of free gas within the drilling fluid 102.

It should be noted that other variations and alternatives are contemplated in addition to the well system 100 illustrated in FIG. 1 and described herein, and therefore any particular example aspect of the well system 100 in no way should be read to limit, or define, the scope of the disclosure.

In the MPD well system 100 of FIG. 1, presently disclosed techniques may be used to control set points of various operating components in the well system 100 to compensate for heave on the drilling rig. For example, the present techniques may enable dynamic calculations of set points for the chokes 166 on the choke manifold 160 and for the BPP 180 to provide precise control of the borehole pressure in response to heave and other effects on the drilling rig detected by various sensors.

Figure 2:
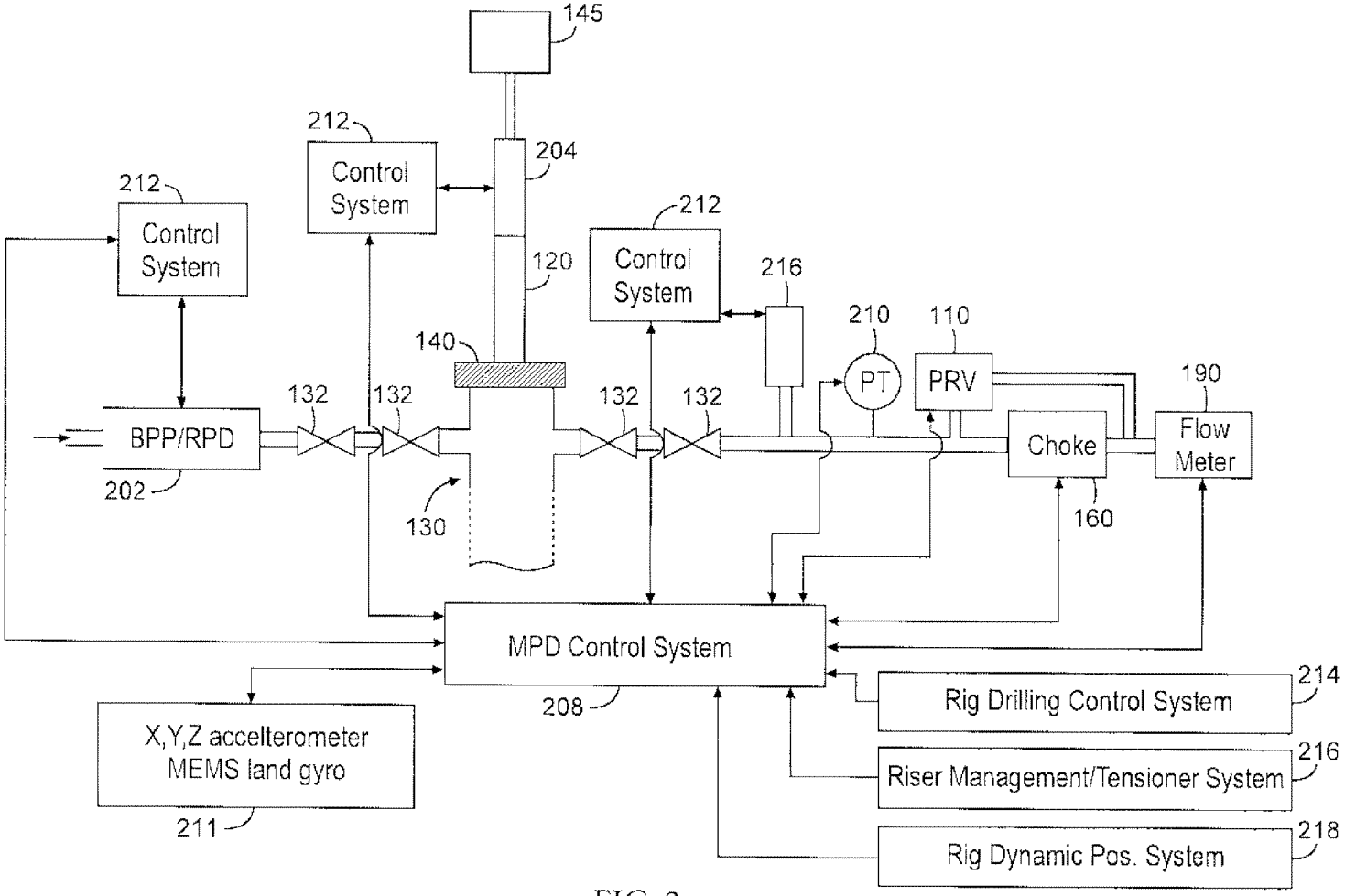
FIG. 2 is a well system and various associated control systems for performing MPD operations, in accordance with an embodiment of the present disclosure.

Another embodiment of a well system 100 that may utilize dynamic set point control to facilitate MPD operations is provided in FIG. 2. As illustrated, the well system 100 of FIG. 2 may feature similar components to those described above with reference to FIG. 1. For example, the well system 100 may include the RCD 140 disposed above the BOP stack 130 to seal a top portion of the drill string 120. In addition, the well system 100 includes the PRV assembly 110, the choke manifold 160, and the flow meter assembly 190.

The well system 100 may also include a BPP/RPD component 202, as illustrated. It should be noted that the BPP/RPD component 202 may include just a BPP, just a RPD, or both a BPP and a RPD that operate together to apply a desired fluid flow to the choke manifold 160 and backpressure to the annulus. Therefore, any discussion herein referring to controlling the BPP/RPD component 202 may refer to controlling an independent BPP, an independent RPD, or both, to provide desired pressure compensation to the borehole. The BPP/RPD component 202 may be configured to deliver a fluid flow from one or more rig pumps or cement pumps into a return flowline for applying a desired backpressure to the annulus.

As described above, some embodiments of the well system 100 may also include a continuous circulation device 204 positioned between the rotary table and standpipe assembly 145 and the drill string 120. The continuous circulation device 204 may facilitate drilling fluid circulation during all MPD drilling operations, including when a new length of drill pipe is being added to the drill string 120. As described below, the continuous circulation device 204, or a pump used to pump fluid into the continuous circulation device 204, may be controlled to help mitigate borehole pressure fluctuations, e.g., due to heave.

The well system 100 may also include a pulsation dampener (not shown) disposed along a fluid return line between the BOP stack 130 and the choke manifold 160. The pulsation dampener may utilize a stored volume of nitrogen or compressible fluid to store sudden volume changes of drilling fluid through the flowline due to borehole pressure fluctuations. As a result, the pulsation dampener may help to mitigate small pressure fluctuations in the borehole, while the choke manifold 160, the BPP/RPD component 202, and/or the continuous circulation device 204 may help to mitigate larger pressure fluctuations in the borehole.

The various equipment that makes up the MPD well system 100 may be rigged up in different combinations or in various different orders than those shown herein. For example, although the BPP/RPD component 202 has to be included in front of the choke manifold 160, the BPP/RPD component 202 may be tied in just before the choke manifold 160, on the riser/flow spool, or on other inlets of the BOP/riser/wellhead assembly. In addition, as described above, the well system 100 may include a BPP, a RPD, a continuous circulation device, a pulsation dampener, or any combination thereof that may be controlled along with the choke manifold 160 via dynamic set point calculations.

In present embodiments, the well system 100 and various components thereof may be controlled by one or more control systems. The illustrated well system 100 may include one or more of a flow and pressure control system 208 (e.g., a MPD control system) that is operatively coupled to the choke manifold 160, the PRV 110, the flow meter 190, and various sensor and control components. For example, the flow and pressure control system 208 may be coupled to one or more sensors 210 (e.g., pressure transducer or temperature sensor) along the flowline between the BPP/RPD component 202 and the choke manifold 160 to execute various control commands based on measured sensor parameters. In addition, the flow and pressure control system 208 may be coupled to one or more position sensors 211 (e.g., X,Y,Z accelerometer or MEMS level gyroscope).

The flow and pressure control system 208 may be coupled to one or more additional control systems 212 that are associated with and designed to interface with certain components of the well system 100. Thus, the control systems 212 may receive and execute instructions communicated from the main flow and pressure control system 208 to operate their associated components (e.g., BPP/RPD component 202, continuous circulation device 204, pulsation dampener 206). Examples of such "interface" control systems are described in detail below. The arrangement of control systems 208, 212 present within the well system 100 may be different in other embodiments. For example, one or more of the control systems 212 may be incorporated into the main flow and pressure control system 208, or additional "interface" control systems 212 may be used within the well system 100 (e.g., interfacing directly with the choke manifold 160 and/or the PRV 110).

As illustrated, the flow and pressure control system 208 may be communicatively coupled to a rig drilling control system 214. The rig drilling control system 214 may interface with the rig directly to provide information related to the drilling operations being performed on the rig to the flow and pressure control system 208. In addition, the flow and pressure control system 208 may be communicatively coupled to a riser management/tensioner system 216. The riser management/tensioner system 216 may provide information related to a riser through which the drill string 120 extends from the drilling rig. Further, the flow and pressure control system 208 may be communicatively coupled to a rig dynamic positioning system 218. The rig dynamic positioning system 218 may provide real-time measurements of the relative position of the rig to the flow and pressure control system 208. The measurements retrieved from the rig drilling control system 214, the riser management/tensioner system 216, the rig dynamic positioning system 218, or a combination thereof, may be used by the flow and pressure control system 208 to enable enhanced borehole pressure control through the well system 100.

Figure 3:
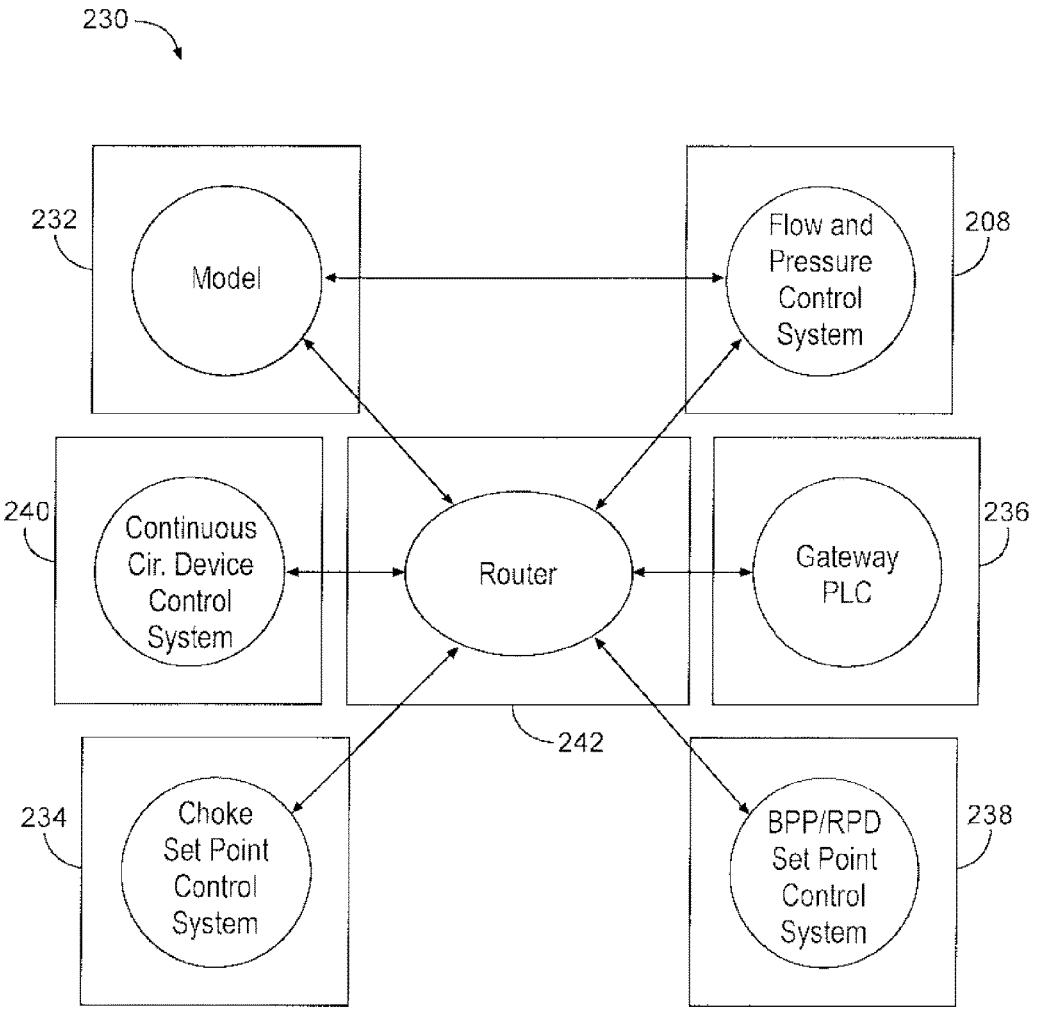
FIG. 3 is a schematic block diagram of a system and network environment that may be used in MPD operations, in accordance with an embodiment of the present disclosure.

FIG. 3 illustrates an example system 230 and network environment that may be used in conjunction with a well, such as but not limited to the well systems 100 of FIGS. 1 and 2. The system 230 may include the flow and pressure control system 208 (e.g., an MPD control system), a model 232 (e.g., a hydraulic model), a choke set point control system 234 (e.g., choke interface/programmable logic controller), a gateway interface 236 (e.g., gateway programmable logic controller), a BPP/RPD set point control system 238, and/or a continuous circulation device control system 240.

The system 230 may also include a router 242 configured to enable data to be routed between one or more networks, systems, and devices. For example, the choke set point control system 234 and the BPP/RPD set point control system 238 may be operatively coupled to the model 232 via the router 242. However, in other embodiments, the flow and pressure control system 208 or one of the set point control systems (e.g., 234, 238, 240) may include the model 232 as a software module or application. Similarly, other systems and/or software modules in the system 230 may be combined or aggregated in various embodiments (e.g., choke set point control system 234, BPP/RPD set point control system 238, and/or continuous circulation device control system 240 may be subsystems or software modules, applications, or the like of the flow and pressure control system 208).

The flow and pressure control system 208 may include various processes for controlling flow and pressure associated with drilling operations (e.g., MPD drilling) of the well system (e.g., well system 100 from FIGS. 1 and 2). In this regard, the flow and pressure control system 208 may be operably coupled to various flow meters and/or sensors to receive data therefrom. The flow and pressure control system 208 may be operably coupled to the gateway interface 236 and other control systems for activating and controlling various devices and components of the well system 100. For example, the gateway interface 236 may be operatively coupled to various valves and switches for controlling the various well and drilling components, as well as to real-time sensors, meters, gauges, etc., for transmitting and receiving data to and from the drilling control network.

Additionally, the flow and pressure control system 208 may be operable to control one or more components of the rotary table and standpipe assembly (e.g., 145 of FIG. 1) to redirect drilling fluid (e.g., 102 of FIG. 1). This may be accomplished by temporarily suspending circulation of the drilling fluid in some embodiments or redirecting the drilling fluid to maintain circulation in other embodiments. Thus, the flow and pressure control system 208 can be configured to control a pressure in the borehole of the well system.

The model 232 may be a subsystem or software module of the flow and pressure control system 208 or may be a standalone system. In some embodiments, the model 232 may be a subsystem or software module of the choke set point control system 234, the BPP/RPD set point control system 238, the continuous circulation device control system 240, or a combination thereof. The model 232 may be of various complexities and may include various input variables and parameters depending on a particular implementation (e.g., modelling well characteristics from a few pressure, flow, and position input variables, or a comprehensive hydraulic model based on numerous input variables and historical data).

The model 232 may be used to determine the desired annulus pressure at or near the wellhead (e.g., 125 of FIG. 1) to achieve a desired borehole pressure at a given point. Data such as but not limited to well geometry, rig positioning, fluid properties, and well information or characteristics may be utilized by the model 232 in conjunction with real-time sensor, meter, and/or gauge data acquired by the gateway interface 236 and/or other devices and interfaces to determine a desired instantaneous annulus pressure.

It should be noted that certain well characteristics and data that are utilized in the model 232 may include relatively static values or parameters (e.g., generally static information about the well that may not change such as, but not limited to, well size). Other well characteristics and data may include dynamic values or parameters (e.g., real-time hole depth measurements, rig positioning information, etc.). For example, in some implementations, the position of the drilling rig (e.g., on a floating vessel) relative to the borehole may change with time due to large waves and other weather-related disturbances to the rig. Therefore, the model 232 may include information regarding historical position data related to the heave on a platform, as well as associated pressure effects resulting in the borehole. Thus, the ideal pressure changes to be implemented in the borehole may be known or calculated based on information and data from the model 232.

The choke set point control system 234 may be operatively coupled to and configured to control the choke manifold 160 of FIGS. 1 and 2. For example, the choke manifold 160 may include a controller (e.g. an auxiliary programmable logic controller, remote input/output device, programmed computer, etc.) operatively coupled to the choke set point control system 234 so that dynamic choke set points may be provided in real-time to one or more chokes on the manifold. The controller for the choke manifold may implement the dynamic set points to cause one or more chokes to increase or decrease flow resistance. The choke set point control system 234 may access the model 232 for determining the set points.

In addition, the BPP/RPD set point control system 238 may be operatively coupled to and configured to control a BPP/RPD component (e.g., 202 of FIG. 2). The BPP/RPD component may include one or more controllers operatively coupled to the BPP/RPD set point control system 238 such that dynamic BPP/RPD set points may be provided in real-time to one or both of the BPP and RPD of the well system. The BPP/RPD set point control system 238 may access the model 232 for determining the dynamic set points.

The continuous circulation device control system 240 may be operatively coupled to and configured to control the continuous circulation device (e.g., 204 of FIG. 2) of the rotary table and standpipe assembly, for example, when a particular implementation of the well system 100 includes continuous circulation functionality. The continuous circulation device control system 240 can communicate with the flow and pressure control system 208 so that drilling fluid may be appropriately diverted/redirected during a connection process.

In some embodiments, the continuous circulation device control system 240 may function as a set point controller. The continuous circulation device may include a controller operatively coupled to the continuous circulation device control system 240 so that dynamic continuous circulation set points may be provided in real-time to the continuous circulation device of the well system. In other embodiments, the continuous circulation device control system 240 may be operatively coupled to one or more pumps (e.g., mud or cement) at the rig such that dynamic pump set points may be provided in real-time to the pumps, which are used to provide drilling fluid flow through the continuous circulation device 204.

The various set point control systems (e.g., choke set point control system 234, BPP/RPD set point control system 238, and/or continuous circulation device control system 240) may utilize the model 232 and certain real-time sensor, meter, and/or gauge data to determine desired instantaneous set points for various well system components. For example, the set point control systems (e.g., 234, 238, 240) may provide instantaneous set points for at least the choke manifold, as well as for the BPP/RPD component or the continuous circulation device/pumps. Similarly, the various set point control systems (e.g., 234, 238, 240) may use the model 232 and certain real-time sensor, meter, and/or gauge data to predict one or more future desired set points (e.g., a series of desired set points based on detected steady-state and/or changing conditions).

It should be noted that, in accordance with aspects of the subject technology, determining dynamic set points is accomplished by the set point control systems 234, 238, and/or 240 in an automated process or processes. However, the set point control systems 234, 238, and/or 240 may be configured for user entry and input such that certain information and control may be afforded a user during the determination of the dynamic set points and/or transmission to the corresponding MPD system components, for example.

The system 230 and network environment may also include other controllable electronic devices (e.g., gauges, flow meters, sensors, alarms, etc.) communicably connected to one or more computers or servers (e.g., control components 208, 234, 238, and/or 240), such as by the router 242 or other networking techniques. In certain embodiments, each of the control components (e.g., 208, 234, 238, and/or 240) may be a single computing device such as a computer server. In other embodiments, the control components (e.g., 208, 234, 238, and/or 240) may represent more than one computing device working together to perform the actions of a server computer (e.g., a distributed system or sharing of certain data). Moreover, in some embodiments, each of these control components (e.g., 208, 234, 238, and/or 240) may be operatively coupled with various databases or other computing devices that may be collocated with the well system, or that may be disparately located.

The choke set point control system 234, the BPP/RPD set point control system 238, and/or the continuous circulation device control system 240, for example, may each include one or more processing devices and one or more data storage devices. One or more processing devices may execute instructions stored in one or more data storage devices, which may store the computer instructions on non-transitory computer-readable medium.

Figure 4:
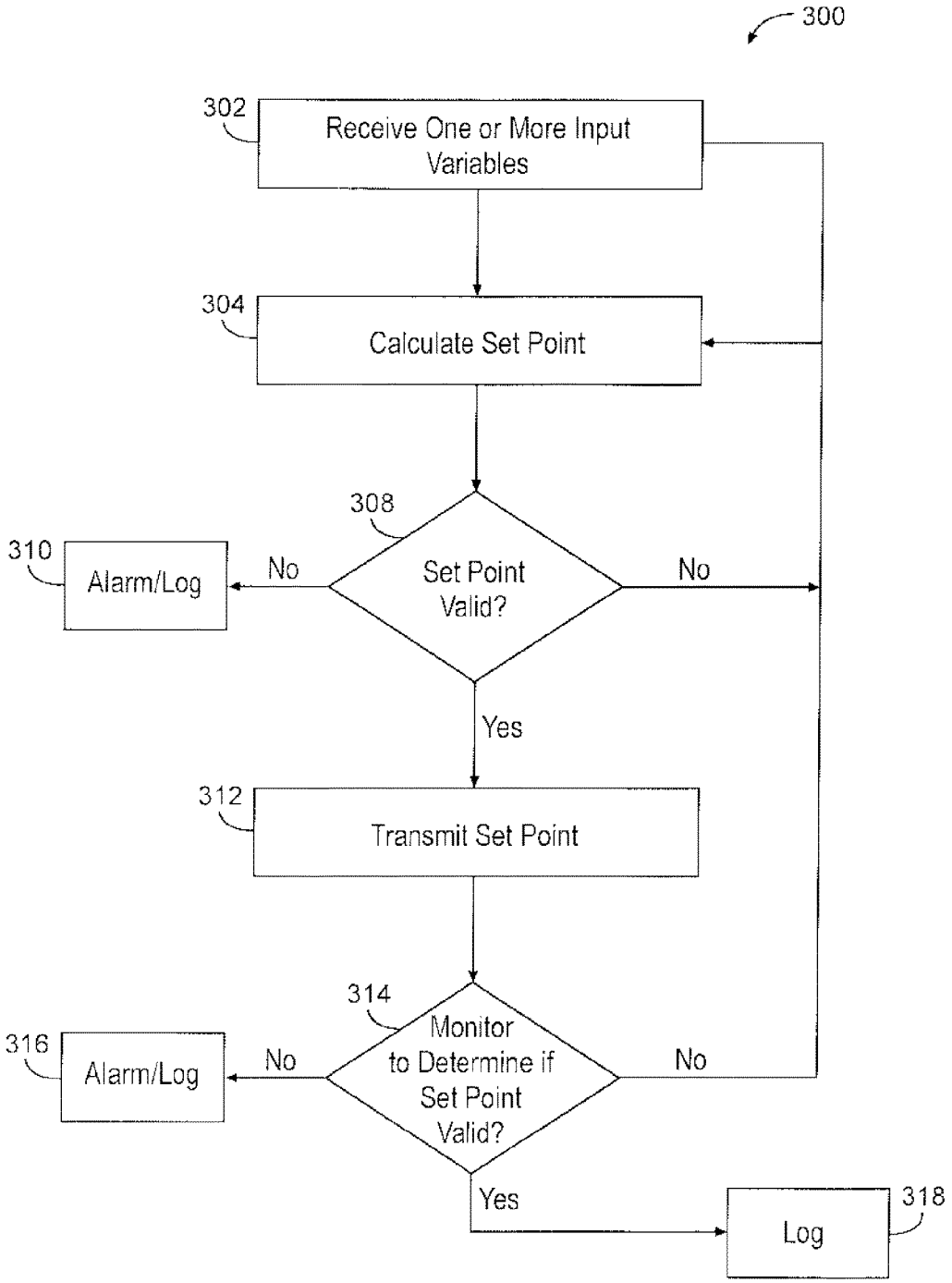
FIG. 4 is a process flow diagram of a method for calculating and providing dynamic set points for controlled MPD operations, in accordance with an embodiment of the present disclosure.

FIG. 4 is a process flow diagram of a method 300 for calculating and providing dynamic set points (e.g., choke set points, BPP/RPD set points, continuous circulation device set points, pump set points, or a combination thereof). It should be noted that the operations in the method 300 may be used in conjunction with other methods/processes and aspects of the disclosure. Although certain aspects of the method 300 are described with relation to the embodiments provided in FIGS. 1-3, the method 300 is not limited to such.

The method 300 may be used in conjunction with the above described well system and network environment to control borehole (or bottom hole or wellbore) pressure during various well and drilling operations. More particularly, this method 300 may be used to provide pressure compensation for heave experienced on the drilling rig, for example, due to waves. The pressure compensation facilitated through this process may prevent undesirable pressure oscillation on the chokes of the choke manifold.

The method 300 may be performed while the rig is in a connection mode and/or under surface pressure control. When the drilling rig operations go to connection mode, the drill string or tubing generally is positioned within and hangs from slips on the rig floor. This allows other drilling rig components (e.g., top drive, etc.) to break out from the string to connect a new length of pipe to the string. During connection mode, the BHA may be static with respect to the rig, since the drill string or tubing is held in the slips. The BHA, therefore, may be affected by rig movement (e.g., due to heave on a floating platform or vessel). In response to rig movement, the BHA and drill string may move up and down through the well/riser, thereby introducing surge and swab piston effects into the borehole. Precise control of the choke, BPP/RPD, and/or continuous circulation device on the drilling rig may counteract these undesirable surge/swab effects, to avoid pressure fluctuations in the closed-in MPD system.

Such precise control of these components may be afforded through the method 300. The method 300 provides an algorithm for utilizing signals from the riser management system (e.g., 216 of FIG. 2), from the rig dynamic positioning system/vessel management system (e.g., 218 of FIG. 2), and the RPM on the rig mud pumps together with the return flow out of the well to continuously calculate the desired dynamic set points.

The dynamic set points described herein may include at least two set points calculated during a desired time period. For example, the set points may include at least one choke set point for operating the choke manifold, along with a BPP set point for operating the BPP system. In other embodiments, the dynamic set points may include at least one choke set point and a RPD set point. In still other embodiments, the dynamic set points may include at least one choke set point and a continuous circulation set point.

In other embodiments, three dynamic set points may be calculated for controlling the different components on the rig to minimize surge/swab effects. For example, the dynamic set points may include a choke set point for operating the choke manifold, a BPP set point for operating the BPP, and a RPD set point for operating a RPD used in conjunction with the BPP. The combinations of set points used to control the well system may be chosen based on the physical components that are present within the particular well system. For example, embodiments of the well system that feature a continuous circulating device might not include a BPP/RPD component to control for pressure differences through the borehole.

In block 302, one or more set point control systems (e.g., 234, 238, or 240 of FIG. 3) may receive one or more input variables associated with characteristics of the well system. The one or more input variables may be received or acquired during a time period, for example, 500 milliseconds, one second, 30 seconds, etc. The time period may change during the course of the method 300 depending on the particular well or drilling operation. Moreover, it is to be understood that certain input variables may be acquired at different time intervals or frequencies than other input variables, and such data acquisition time intervals may be different from the time period associated with receiving the one or more variables.

The one or more input variables and/or parameters may include data from the rig, platform, or other top-side equipment and/or BHA data (e.g., from the rig drilling control system 214 of FIG. 2). For example, the one or more input variables may include, but are not limited to, 'flow in', 'bit depth', 'hole depth', 'stand pipe pressure', 'hookload', 'rotary speed', 'rotary torque', 'wellhead pressure', 'density in', 'temperature in', 'BHA temperature,' 'BHA pressure,' and 'BHA equivalent circulating density (ECD)'.

In addition, the one or more input variables and/or parameters may include data from the riser management/tensioner system 216 of FIG. 2. For example, the one or more input variables may include, but are not limited to, 'tension', 'movement', and 'weight'. Further, the one or more input variables and/or parameters may include data from the rig dynamic positioning system 218 of FIG. 2. For example, the one or more input variables may include, but are not limited to, 'heave', 'roll', 'pitch', and 'riser disconnect'.

In accordance with certain aspects, 'bit depth' may be determined at a particular instance in time. For example, during the certain instances of drilling operation, the 'bit depth' and the 'hole depth' may simultaneously increase and be the same. However, 'bit depth' may change as the drill bit is retracted from the borehole during some drilling operations. 'Bit depth' and 'hole depth' may be values in feet or meters. In addition, 'bit depth' may change as the rig moves up and down relative to the borehole due to heave, for example, on a floating platform or vessel.

'Stand pipe pressure' may be measured and/or calculated in bars, PSI, or pascals. 'Hookload' may be measured and/or calculated in tons. 'Rotary speed' relates to the rotary speed of the drill string and may be a value in revolutions per minute (RPM) or radians per second. 'Rotary torque' relates to the rotary torque of the drill string, and may be expressed in newton meters or foot pounds. 'Wellhead pressure' relates to the actual pressure value of the wellhead as measured at the choke manifold, and may be a value in bars, PSI, or pascals.

In certain aspects, 'flow in' relates to a rate of the flow of drilling fluid into the borehole from drilling fluid pumps, and can be measured by or derived from the drilling fluid pumps or a separate sensor or flow meter, for example. 'Flow in' may be directly measured or calculated from other data, and may be expressed in liters per minute. 'Density in' relates to a density of the drilling fluid flowing into the borehole from the rig or platform, and can be similarly measured by or derived from the drilling fluid pumps or a separate sensor/flow meter. Density of the drilling fluid can be measured in kilograms per liter. 'Temperature in' relates to an instantaneous temperature of the drilling fluid flowing into the borehole from the rig or platform, and can be measured by or derived from the fluid pumps or a separate sensor.

It is to be understood that, in some aspects, 'flow in', 'density in', and 'temperature in' may relate to fluids other than drilling fluid. For example, 'flow in', 'density in', and 'temperature in' may relate to a cement composition that can be supplied by one or more cement pumps on the rig or platform.

Additional non-limiting examples of input variables include 'BHA temperature,' 'BHA pressure,' and 'BHA ECD.' For example, BHA temperature, pressure, and ECD can be acquired by and/or determined from measuring devices in the bottom hole assembly such as but not limited to one or more sensors of the drill string.

In certain embodiments, input variables from the riser management/tensioner system or the rig dynamic positioning system may be used. 'Tension', 'movement', and 'weight' may relate to forces and displacements of a riser or tensioner used to direct the drill string or tubing/casing from a floating platform (rig) to a subsea wellhead. 'Heave', 'roll', and 'pitch' may relate to a relative position or orientation of one or more points on the drilling rig, particularly when the rig is on a floating vessel or otherwise subjected to repeated movements. In addition, 'riser disconnect' may provide an indication as to whether a riser is connected to the rig.

In block 304, the set point control system may calculate one or more set points. The set points may include at least a choke set point for operating the choke manifold. The set points may also include a BPP set point for operating a backpressure pump system, a RPD set point for operating a rig pump diverter, or both. Furthermore, in some embodiments, the set points may include a continuous circulation set point for operating the continuous circulation device or a mud pump or cement pump operatively coupled thereto.

The set points may be calculated based at least partially on the model (e.g., 232 of FIG. 3) and may utilize the one or more input variables. In this regard, the model in the well system may utilize one or more of the various input variables and additional information associated with the rig or platform equipment and subterranean formation. In some embodiments, the model can provide an instantaneous pressure profile of the well. For example, the model 232 may provide pressure information indicative of either surge or swab piston effects occurring or beginning to occur within the borehole due to relative movement of the drill string through the well/riser. When drilling rig 'heave' or riser 'tension' input variables change, for example, a resulting pressure profile of the model may likewise change.

Accordingly, the model, from which the pressure profile of the well and the set points may be calculated, is continuously changing throughout various well and drilling operations. For example, different pressure changes within the borehole during the connection mode of the drilling process may substantially alter the model of the well. Thus, in certain aspects, the set point control systems are configured to dynamically calculate a plurality of set points as the drill extends or retracts meter by meter within the reservoir and second by second based on the information in the model and the received one or more input variables.

For example, the model may utilize the following equation to calculate an instantaneous borehole or bottom hole pressure: BHP (bottom hole pressure)=hydrostatic pressure (e.g., drilling fluid weight)+frictional pressure (ECD)+backpressure (e.g., applied by choke manifold, BPP, and RPD). This BHP equation and the various components thereof may be solved using the one or more input variables as updated by real-time sensor, meter, and/or gauge data in accordance with aspects of the present disclosure.

In some implementations, for example, some of the general guidelines or ranges associated with a given drilling environment may be known based on historical data of the various input variables or parameters of the well. Additionally, during certain drilling operations, the set point control systems may be configured to detect a condition in which the pressure profile is expected to be generally stable. As such the time period or intervals at which the one or more input variables are received and/or the set points are calculated may be increased (e.g., less frequent calculation of dynamic set points). In this regard, a limited number of input variables and/or parameters may be required to calculate the dynamic set points within an estimated range, for example, thereby limiting the processing burden on one or more processors of the set point control systems.

In some embodiments, the calculation of the set points may include adding an offset value to the computed value for the various set points. For example, a set point control system may provide an offset as a parameter to be used in computing or calculating the desired set point. In some aspects, the offset parameter may be provided by a well operator based on known characteristics of the rig or platform equipment and the formation. The offset parameter may be a static value for a specific implementation and added to the set point as initially computed by the set point control system. In some embodiments, the offset parameter may be a variable and applied based on a determined mode of operation. For example, a first offset value may be used when the rig or platform is in drilling mode as determined by one or more input variables, and a second offset value may be used when the rig or platform equipment is in connection mode as similarly determined by input variables.

In block 308, the set point control systems may determine whether the calculated set points are valid. The set point control systems may base such a determination at least partially on a predetermined expected range of the set points for the well. For example, as noted herein, the model may include information regarding various known characteristics about a particular drilling environment. As such, expected ranges of set points for the well may be calculated by the one or more set point control systems.

In some embodiments, a user may enter parameters into the set point control systems indicating the expected range of set points for the well. Thus, the predetermined expected range of set points can be the user-entered set points or the user-entered set points modified or adjusted by one or more characteristics associated with the model in accordance with various embodiments.

If one or more of the calculated set points are determined to be invalid, the set point control system associated with the invalid set point may determine whether an input variable value of one of the received input variables is out of variance with a predetermined range of acceptable input variable values. For example, one or more of the input variables may include a range of acceptable values based on actual historical data, expected ranges for the specific well system configuration, and/or user-entered parameters.

When a received input variable value is determined to be out of variance, the set point control system may then recalculate the desired set point based at least partially on the model utilizing a default value for the input variable, for example. In some embodiments, the default value may be the last received valid value for that particular input variable and a recalculation may be performed to determine the set point (e.g., return to block 304). In other embodiments, a new value for the out of range input variable value may be attempted to be acquired. For example, the presently received one or more input variables may be disregarded, and the set point control system may receive a new one or more input variables associated with one or more characteristics of the well system (e.g., return to block 302).

If one or more calculated set points are determined to be invalid, the set point control system associated therewith may generate an alarm (block 310). The alarm generated by the presumed invalid set point may be logged so that the incident may be reviewed at a later time to determine the cause of the presumed miscalculation (e.g., faulty telemetry or malfunctioning components).

As shown in block 312, if one or more of the calculated set points are determined to be valid, the associated set point control system may transmit the calculated set point to one or more controllers associated with the well system component (e.g., choke, BPP/RPD, or continuous circulation device). In this regard, the set point control system can control operation of and change the mechanical settings of the associated well system component.

Next, as shown in block 314, the set point control system may monitor the well system component to determine whether the calculated set point is valid. For example, one or more sensing components (e.g., pressure sensor, flow rate sensor) may be used to monitor a borehole pressure or bottom hole pressure along with a flow rate of fluid through the borehole. These sensor measurements may indicate whether the borehole pressure has been effectively controlled to mitigate surge/swab effects from a drill string or tubing/casing moving up and down through the borehole. The pressure sensor may be disposed at any desired fixed point within the well such as, for example, at a shoe along the drill string, at the drill bit, or some other location in the well. The flow rate sensor may be built into the one or more mud pumps or may be a separate sensor or flow meter for monitoring the fluid flow through the closed-in well system. A controller (e.g., flow and pressure control system) associated with the sensing components may provide an indication to one or more set point control systems when the sensed pressure and/or flow rate through the borehole falls outside of acceptable ranges.

When a calculated set point is transmitted to one or more controllers associated with the well system component (e.g., choke, BPP/RPD, or continuous circulation device), and the sensed pressure falls outside of a desired range, the associated set point control system may generate an alarm (block 316). The alarm generated by the presumed valid and calculated set point may be logged along with other concurrent data points so that the incident may be reviewed at a later time to determine the cause of the incident (e.g., faulty telemetry, malfunctioning components, unexpected BHA temperature or pressure change, etc.). Additionally, in some embodiments, upon receiving an alarm, the set point control system may immediately recalculate or increase a frequency of calculating the set points (e.g., increase from a 10 millisecond to a 1 millisecond time interval for calculating set points).

Moreover, in block 318, the set point control systems may log each of the calculated set points that are transmitted to the various controllers associated with the well system components (e.g., choke manifold, BPP/RPD, continuous circulation device, etc.), so that the set points that did not result in an incident can be later used for further analysis and historical data of the borehole pressure in the well.

Figure 5:
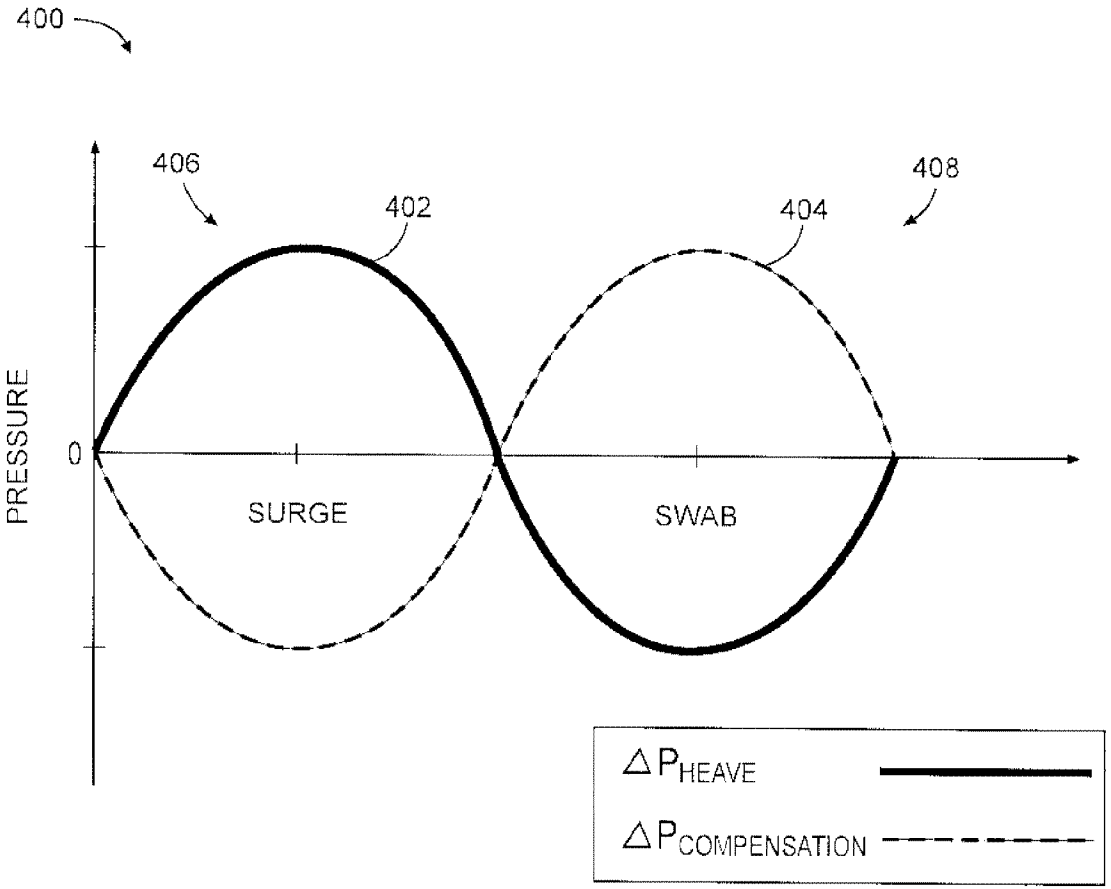
FIG. 5 is a plot of borehole pressure changes associated with heave and heave-compensation in a MPD environment, in accordance with an embodiment of the present disclosure.

FIG. 5 is a plot 400 illustrating the borehole pressure effect caused by movement of the rig due to heave. As shown, a heave pressure change line 402 illustrates the change in pressure within the borehole that can be attributed to the movement of the drilling rig due to waves. A compensating pressure change line 404 illustrates the change in pressure that is desired to mitigate the pressure effects due to heave.

The plot 400 shows a single sinusoidal cycle of pressure differences through the borehole. The first half 406 of the sinusoidal cycle illustrates a surge effect through the borehole. The movement of the rig downward relative to the borehole forces the drill string further into the borehole and against drilling fluid in the annulus, thereby increasing the pressure throughout the borehole. The second half 408 of the sinusoidal cycle illustrates a swab effect through the borehole. That is, the movement of the rig upward relative to the borehole pulls the drill string further out of the borehole and draws additional drilling fluid downward through the annulus, thereby decreasing the pressure throughout the borehole.

The dynamic set points described herein may be calculated and implemented in real-time or near real-time to counter the illustrated surge and swab effects on borehole pressure 402 due to heave. As such, the dynamic set points may be chosen to provide the compensating pressure change 404 within the borehole, to counteract any surge/swab effects.

As mentioned above, the types of dynamic set points that are used to control pressure compensation for surge and swab effects within the borehole may be different for well systems featuring different types of components. For example, the set points used to control pressure compensation in a well system with a continuous circulation device (e.g., 204 of FIG. 2) may be different from the set points used to control pressure compensation in a well system without a continuous circulation device. Examples of both cases are provided below.

Figure 6:
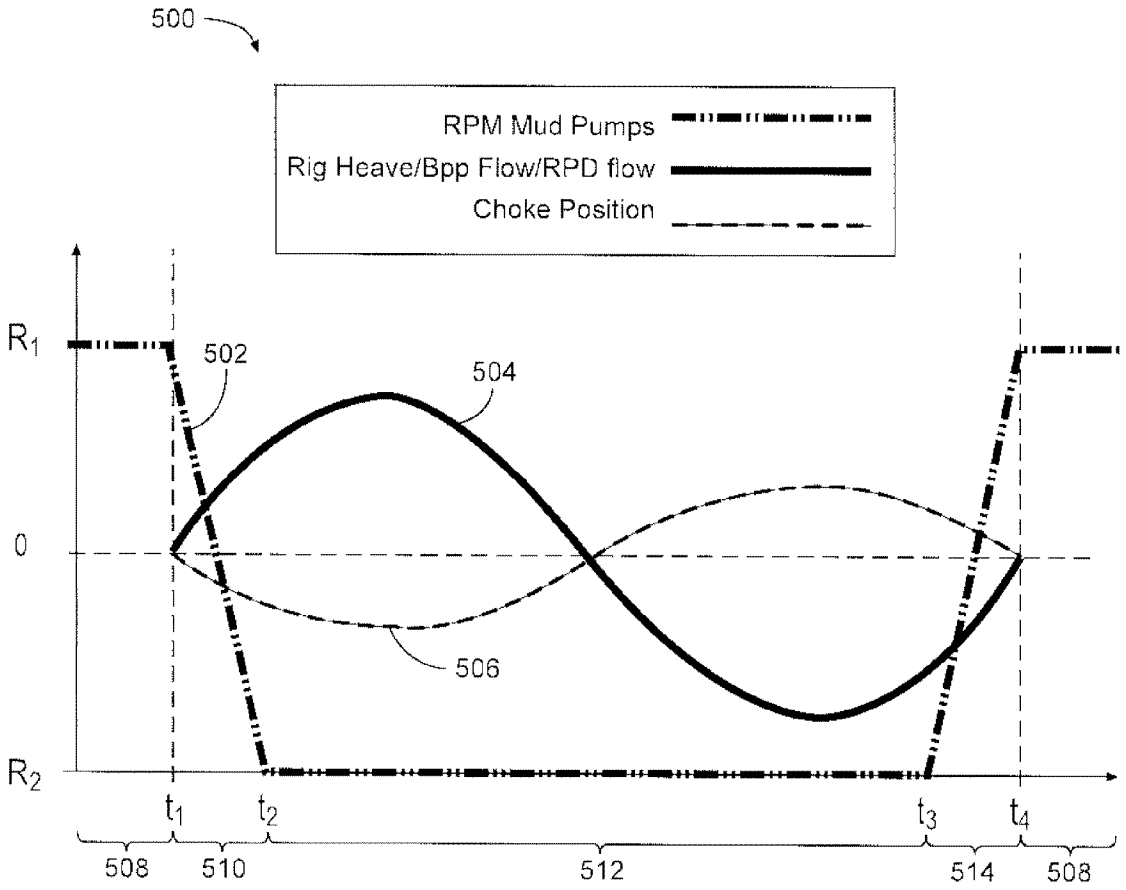
FIG. 6 is a plot of dynamic choke, backpressure pump, and rig diverter pump set points associated with heave compensation in a MPD environment, in accordance with an embodiment of the present disclosure.

FIG. 6 is a chart 500 that depicts dynamic set points (e.g., choke set points and BPP/RPD set points) as plotted with respect to time. The chart 500 relates to an example of a drilling operation in which rotation of the drill string and a flow of drilling fluid through the borehole are temporarily stopped when an additional drill pipe is added to the drill string. That is, the illustrated chart 500 shows the dynamic set points used when the well system is operating in a connection mode. The illustrated chart 500 shows the dynamic set points predicted for a well system operating without a continuous circulation device. As a result, the pressure at the surface of the closed-in MPD system may be relatively higher to compensate for not having an equivalent circulating density of fluid through the system.

The chart 500 features a RPM line 502, a rig heave/BPP flow/RPD flow line 504, and a choke set point line 506, all of which show changes in respective values of the lines during various drilling operations. The RPM line 502 (i.e., pump RPM) may refer to the rotary speed of a crankshaft or piston of one or more pumps (i.e., mud pumps or cement pumps). By using the rotary speed of the crankshaft and other pump data such as displacement (e.g., stroke and bore) with other data associated with the pump in use, a flow rate of the fluid injected into the borehole may be calculated. In this regard, the RPM line 502 may be representative of 'flow in' and correlated thereto. The various set point control systems may use the pump RPM to calculate the various dynamic set points. The pump rate may also be calculated by stroke counters, although this measurement may not provide the same level of accuracy.

The rig heave/BPP/RPD flow line 504 may be representative of BPP/RPD set points calculated by the BPP/RPD set point control system of FIG. 3, in accordance with aspects of the present disclosure. Similarly, the choke set point line 506 may be representative of choke set points (i.e., choke positions) calculated by the choke set point control system of FIG. 3.

As shown, during a drilling mode 508 from time 0 to time t1, the pump RPM may be at a steady-state value R1. At this time, the various set point control systems may not be actively calculating and providing set points to the choke manifold and BPP/RPD component to compensate for heave. This is because heave on the drilling rig may not affect the position of the drill string within the borehole until the drill string is positioned into the slips on the rig. Thus, during this time, heave compensation using the choke and the BPP/RPD components may not be desired. In other embodiments, the check point control systems may constantly calculate and provide new set points to the well system components, regardless of the operating mode. Even so, while the drill string is not supported in the slips on the rig, the calculations may result in generally steady-state set point values for the choke and BPP/RPD.

At time t1, the drill string may be coupled to the rig floor via the slips, such that the motion (i.e., heave) of the rig may be transferred to relative motion of the drill string within the borehole. Due to the oscillation between increasing and decreasing length of the drill string in the borehole, a volume of fluid in the borehole/riser may also increase and decrease, which could result in pressure effects (i.e., surge/swab) if the left uncompensated. At this point, the BPP/RPD set point control system may calculate and provide set point values to the BPP/RPD for ramping up/down the flow of backpressure fluid into the borehole, thereby compensating largely for the heave effects downhole. The BPP/RPD dynamic set points may help to counter the change in fluid volume in the borehole brought on by heave. The pressure effect of the BPP/RPD set points is shown in the rig heave/BPP/RPD flow line 504.

To fine tune the process and further reduce pressure fluctuations in the borehole, the choke set point control system may calculate and provide set point values to the choke manifold for adjusting the position of one or more chokes according to the illustrated choke set point line 506 illustrated in the chart 500. This fine-tuning may help to remove any remaining deviation from a set point on the surface pressure.

During a pump ramp down mode 510 from time t1 to time t2, the pump RPM may decrease in preparation for a drill pipe connection, in accordance with certain embodiments. As such, the pump RPM may decrease from the value R1 to a zero (or near zero) value R2.

Additionally, the various set point control systems may be configured to detect that drilling operations have transitioned from the drilling mode 508 to the pump ramp down mode 510. In this regard, the set point control systems may be configured to detect a condition reflecting a mode or stage for which frequent changing of set points for the choke manifold and the BPP/RPD may aid in maintaining precise borehole pressure during certain changing conditions of the well system. As such, the time period or intervals at which the one or more input variables are received and/or the set points are calculated may be decreased (e.g., more frequent calculation of dynamic set points). For example, the set point control systems may be configured to detect a threshold change in an input variable where the threshold change is triggered based on a particular value of the input variable or a particular increase/decrease in value of the input variable over a specific period of time.

During a connection mode 512 from time t2 to time t3, the pump RPM 502 may remain at the zero (or near zero) value R2. However, throughout the connection mode 512, the set point control systems of the well system may continuously calculate and implement set points within the choke manifold and the BPP/RPD to compensate for heave.

During the connection mode 512, a new drill pipe may be added top-side to drill string via the top drive of rotary table and standpipe assembly. During a pump ramp up mode 514 from time t3 to time t4, the drilling fluid pumps may begin activating and the pump RPM 502 may increase as drilling operations move toward full speed with the new drill pipe connected to drill string. As such, the pump RPM 502 may increase from the value R2 back to the value R1. During this time, the set point control systems may continue to calculate and implement dynamic set points for the choke manifold and the BPP/RPD, since the drill string may still be held in the slips at this time.

At time t4, the drill string may be let out of the slips on the rig, and the well system may return to the drilling mode 508. As such, the pump RPM 502 may return to the steady-state value R1. It should be noted that the chart 500 is merely an example for illustrating a relationship between the pump RPM and the calculated BPP/RPD/choke set point values. However, the calculated BPP/RPD/choke set points may factor in numerous input variables, and therefore may or may not generally resemble the illustrated BPP/RPD set point line 504 and choke set point line 506 in various embodiments and implementations.

Moreover, while the chart 500 illustrates a single full cycle of heave pressure compensation (via the BPP/RPD set points and the choke set points) that occurs over the time period t1-t4, a larger number of heave compensation cycles may be executed in other instances. In cases where multiple pressure compensation cycles occur over a time period, the calculated set points may be different for different cycles due to changes in the input variables, among other things.

The example given in FIG. 6 for calculating and implementing pressure compensation set points throughout a connection mode is related to a well system that does not feature a continuous circulating device. It should be noted that the control method may be slightly different in well systems that do include a continuous circulation device. Specifically, in well systems with a continuous circulating device, the one or more pumps are generally not ramped down when the system goes to connection mode and back up when the system goes to drilling mode. Instead, the pumps may operate throughout the connection mode.

In embodiments having a continuous circulating system available, the MPD well system might not include the BPP/RPD component at all. Instead of calculating BPP/RPD set points for controlling operation of a BPP/RPD component, the disclosed system may utilize the continuous circulation control system to calculate and implement continuous circulation set points to compensate for a large portion of the heave effect downhole. That is, the continuous circulation control system may calculate and provide set points to the continuous circulation device or a designated pump to provide the desired flow rate of fluid for heave pressure compensation. The flow rate of the fluid through the continuous circulation device would thus be controlled to oscillate in a way that counteracts the heave pressure changes. The choke set point control system may still be used to provide fine-tuning to help remove any remaining deviation from a set point on the surface pressure.

In some embodiments, the set point control systems and methods described herein may incorporate an active forward coupling on incoming heave on the drilling rig. That is, signals of input variables received from the rig drilling control system, the riser management/tensioner system, and the rig dynamic positioning system may be received at the flow and pressure control system to help build a predictive model. In addition, sensors such as, but not limited to, accelerometers, gyroscopes, and motion reference units (MRUs) may be fitted to one or more chokes on the choke manifold to measure relative movements with the waves generating the heave on the floating drilling rig/vessel. The data collected from these sensors may be used to predict appropriate upcoming set points for well system equipment. For example, the wave patterns may generally repeat themselves, making the pressure compensation fairly easy to predict. By tracking the wave patterns, the control system may recognize patterns (e.g., every seventh wave slightly larger than the waves immediately before and after it).

In addition, the flow and pressure control system may include an emergency stop feature for shutting off the BPP and/or the RCD of the well system, thereby isolating the BOP stack to prevent a backflow through the choke and to the riser. This will prevent spillage of any drilling or completion fluid to sea in the event that there is a disconnect from the rig.

Although the disclosure and its advantages have been described in detail, it should be understood that various changes, substitutions and alterations can be made herein without departing from the spirit and scope of the disclosure as defined by the following claims.

What is claimed is:

1. A method, comprising:

receiving, at a processor, input variables associated with characteristics of a well system during a first time period, wherein the well system comprises a floating platform that is subject to heave, wherein at least one of the input variables comprises a tension or weight on a riser/tensioner used to direct a tubular string from a floating platform to a subsea wellhead, and wherein at least one of the input variables comprises a pressure measurement at a surface of the well system;

calculating a first choke set point based on one or more of the input variables received during the first time period;

determining whether the first choke set point is valid based on a predetermined expected range of choke set points for the well system; and transmitting the first choke set point to a choke controller associated with a choke manifold of a managed pressure drilling (MPD) system, when the first choke set point is determined to be valid.

2. The method of claim 1, further comprising:

calculating a first backpressure pump or rig pump diverter (BPP/RPD) set point by determining an expected change in fluid volume in a borehole brought on by heave of the well system based on the measured tension or weight on the riser/tensioner, and determining a flow rate of fluid to be output through the BPP/RPD component to directly counteract the expected change in fluid volume;

determining whether the first BPP/RPD set point is valid based on a predetermined expected range of BPP/RPD set points for the well system;

transmitting the first BPP/RPD set point to a BPP/RPD controller for controlling a flow rate of fluid through a BPP/RPD component of the MPD system, when the first BPP/RPD set point is determined to be valid; and calculating the first choke set point by comparing the detected pressure measurement at the surface of the well system to a predetermined surface pressure set point and determining a first choke position to directly counteract any deviation of the pressure measurement from the surface pressure set point.

3. The method of claim 2, further comprising:

tracking a wave pattern over time via the processor based on the detected tension or weight on the riser/tensioner taken over time; and predicting one or more additional BPP/RPD set points based on the first BPP/RPD set point and based on the wave pattern.

4. The method of claim 2, further comprising:

determining whether the well system is operating in a connection mode where a tubular string is hanging in slips from the floating platform; and calculating the first BPP/RPD set point based on the detected tension or weight on the riser/tensioner only if the well system is operating in the connection mode.

5. The method of claim 1, further comprising:

calculating a first continuous circulation set point by determining an expected change in fluid volume in a borehole brought on by heave of the well system based on the measured tension or weight on the riser/tensioner, and determining a flow rate of fluid to be output through the continuous circulation device to directly counteract the expected change in fluid volume;

determining whether the first continuous circulation set point is valid based on a predetermined expected range of continuous circulation set points for the well system;

transmitting the first continuous circulation set point to a continuous circulation controller for controlling a flow rate of fluid through a continuous circulation device, when the first continuous circulation set point is determined to be valid; and calculating the first choke set point by comparing the detected pressure measurement at the surface of the well system to a predetermined surface pressure set point and determining a first choke position to directly counteract any deviation of the pressure measurement from the surface pressure set point.

6. The method of claim 5, further comprising:

tracking a wave pattern over time via the processor based on the detected tension or weight on the riser/tensioner taken over time; and predicting one or more additional continuous circulation set points based on the first continuous circulation set point and based on the wave pattern.

7. The method of claim 5, further comprising:

determining whether the well system is operating in a connection mode where a tubular string is hanging in slips from the floating platform; and calculating the first continuous circulation set point based on the detected tension or weight on the riser/tensioner only if the well system is operating in the connection mode.

8. The method of claim 1, wherein the input variables further comprise at least one of a roll, pitch, or heave of a drilling rig as sensed via a rig dynamic positioning system.

9. The method of claim 1, further comprising:

determining, when the first choke set point is determined to be invalid, whether an input variable value of one of the input variables is out of variance with a predetermined range of acceptable input variable values;

recalculating, when the input variable value corresponding to the one of the input variables is determined to be out of variance, the first choke set point based on the model of the well system utilizing a default value for the one of the one or more input variables; and transmitting the first choke set point to the choke controller when the first choke set point is determined to be valid.

10. The method of claim 1, further comprising:

receiving, at the processor, input variables associated with one or more characteristics of the well system during a second time period different than the first time period;

calculating a second choke set point based on the input variables received during the second time period;

determining whether the second choke set point is valid based on a predetermined expected range of choke set points for the well system; and transmitting the second choke set point to the choke controller when the second choke set point is determined to be valid.

11. The method of claim 10, further comprising predicting one or more additional choke set points based on the first choke set point and the second choke set point.

12. The method of claim 1, further comprising calculating the first choke set point based on a model of the well system utilizing the input variables received during the first time period.

13. The method of claim 1, wherein the MPD system is operating in a connection mode during the first time period.

14. A well system, comprising:

a blowout preventer (BOP) stack;

a choke manifold operatively coupled to the BOP stack;

a backpressure pump or rig pump diverter (BPP/RPD) component operatively coupled to the choke manifold; and a computer system that includes a processor and memory including instructions that, when executed by the processor, cause the processor to:

receive one or more input variables associated with one or more characteristics of the well system, wherein at least one of the one or more input variables comprises a tension, movement, or weight on a riser/tensioner used to direct a tubular string from a floating platform to the BOP stack, and wherein at least one of the one or more input variables comprises a pressure measurement at a surface of the well system;

calculate one or more BPP/RPD set points by determining an expected change in fluid volume in a borehole brought on by heave of the well system based on the measured tension, movement, or weight on the riser/tensioner, and determining a flow rate of fluid to be output through the BPP/RPD to directly counteract the expected change in fluid volume;

determine whether the one or more BPP/RPD set points are valid based on a predetermined expected range of BPP/RPD set points for the well system;

transmit the one or more BPP/RPD set points to a BPP/RPD controller for controlling a flow rate of fluid through the BPP/RPD component when the one or more BPP/RPD set points are determined to be valid;

calculate one or more choke set points by comparing the detected pressure measurement at the surface of the well system to a predetermined surface pressure set point and determining one or more choke positions to directly counteract any deviation of the pressure measurement from the surface pressure set point;

determine whether the one or more choke set points are valid based on a predetermined expected range of choke set points for the well system; and transmit the one or more choke set points to a choke controller for controlling one or more chokes on the choke manifold when the one or more choke set points are determined to be valid.

15. The well system of claim 14, further comprising one or more drilling fluid pumps, wherein the BPP/RPD component is operatively coupled to the one or more drilling fluid pumps and to the choke manifold for diverting drilling fluid flow from the one or more drilling fluid pumps to the choke manifold.

16. The well system of claim 14, wherein the instructions, when executed by the processor, further cause the processor to:

predict one or more additional BPP/RPD set points based on the calculated one or more BPP/RPD set points; and predict one or more additional choke set points based on the calculated one or more choke set points.

17. A well system, comprising:

a blowout preventer (BOP) stack;

a choke manifold operatively coupled to the BOP stack;

a continuous circulation device operatively coupled to a drill string extending through the BOP stack for providing continuous drilling fluid circulation by allowing the one or more drilling fluid pumps to stay active when a new drill pipe segment is being connected to the drill string; and a computer system that includes a processor and memory including instructions that, when executed by the processor, cause the processor to:

receive one or more input variables associated with one or more characteristics of the well system, wherein at least one of the one or more input variables comprises a tension, movement, or weight on a riser/tensioner used to direct a tubular string from a floating platform to the BOP stack, and wherein at least one of the one or more input variables comprises a pressure measurement at a surface of the well system;

calculate one or more continuous circulation set points by determining an expected change in fluid volume in a borehole brought on by heave of the well system based on the measured tension, movement, or weight on the riser/tensioner, and determining a flow rate of fluid to be output through the continuous circulation device to directly counteract the expected change in fluid volume;

determine whether the one or more continuous circulation set points are valid based on a predetermined expected range of continuous circulation set points for the well system;

transmit the one or more continuous circulation set points to a continuous circulation controller for controlling the flow rate through the continuous circulation device when the one or more continuous circulation set points are determined to be valid;

calculate one or more choke set points by comparing the detected pressure measurement at the surface of the well system to a predetermined surface pressure set point and determining one or more choke positions to directly counteract any deviation of the pressure measurement from the surface pressure set point;

determine whether the one or more choke set points are valid based on a predetermined expected range of choke set points for the well system; and transmit the one or more choke set points to a choke controller for controlling one or more chokes on the choke manifold when the one or more choke set points are determined to be valid.

18. The well system of claim 17, wherein the instructions, when executed by the processor, further cause the processor to:

predict one or more additional continuous circulation set points based on the calculated one or more continuous circulation set points; and predict one or more additional choke set points based on the calculated one or more choke set points.

19. The well system of claim 17, further comprising a backpressure pump (BPP) operatively coupled to the choke manifold, a rig pump diverter (RPD) operatively coupled to the choke manifold, or both.

* * * * *